United States Patent [19]

Derp et al.

[11] Patent Number: 5,058,655

[45] **Date of Patent: * Oct. 22, 1991**

[54] METHOD AND APPARATUS FOR MANUFACTURING OF A THICK-WALLED HOLLOW CASTING OF CAST IRON

[75] Inventors: Helmut Derp, Mulheim; Horst Keese, Rodenbach; Elmar Schlich, Gründau, all of Fed. Rep. of Germany

[73] Assignees: Thyssen Industrie AG; Transnuklear GmbH, both of Fed. Rep. of Germany

[ * ] Notice: The portion of the term of this patent subsequent to Aug. 22, 2004 has been disclaimed.

[21] Appl. No.: 841,167

[22] Filed: Mar. 19, 1986

Related U.S. Application Data

[63] Continuation-in-part of Ser. No. 604,825, Apr. 27, 1984, abandoned, which is a continuation of Ser. No. 376,157, May 7, 1982, abandoned.

[30] Foreign Application Priority Data

May 13, 1981 [DE] Fed. Rep. of Germany ..... 3118928

[51] Int. Cl.[5] ..... B22D 27/04

[52] U.S. Cl. ..... 164/128; 164/126; 164/348; 164/354; 249/135; 249/175

[58] Field of Search ..... 164/122, 125–128, 164/458, 132, 352–356, 363, 365, 348; 249/135, 175

[56] References Cited

U.S. PATENT DOCUMENTS

| | | | |
|---|---|---|---|
| 4,269,258 | 5/1981 | Sonntag et al. | 164/132 X |
| 4,278,124 | 7/1981 | Aso et al. | 164/348 X |

FOREIGN PATENT DOCUMENTS

| | | | |
|---|---|---|---|
| 1952009 | 4/1971 | Fed. Rep. of Germany . | |
| 50-28898 | 9/1975 | Japan | 164/348 |
| 54-5820 | 1/1979 | Japan | 164/122 |

*Primary Examiner*—Kuang Y. Lin

*Attorney, Agent, or Firm*—McGlew and Tuttle

[57] ABSTRACT

A method of manufacturing a thick-walled container casting of a cast iron with a spheroidal graphite comprises forming an inflexible mold spaced between an inner cylindrical dead mold core and an outer mold arranged over the dead mold core, filling the mold space through a gate from an end thereof while cooling particularly the inner mold surface of the mold ajacent the dead mold over the amount of a cooling of a usual sand casting, and dimensioning the gate so that the cast iron solidifies in the gate before the eutectic solidification of the casting sets in. The device comprises an inner cylindrical dead bolt core which has a bottom end and a closed top end and an outer cylindrical mold positioned over the inner core with its top spaced from the top end of the inner dead mold core. The bottom open ends of the inner and outer cylindrical molds are closed by means which define a mold filling closure having a gate dimensioned so that the filling of the mold will effect first the solidification in the gates.

3 Claims, 4 Drawing Sheets

METHOD AND APPARATUS FOR MANUFACTURING OF A THICK-WALLED HOLLOW CASTING OF CAST IRON

CROSS-REFERENCE TO RELATED APPLICATION

The present application is a continuation-in-part of Ser. No. 604,825 filed April 27th, 1984 which, in turn, was a continuation of Ser. No. 376,157 filed May 7th, 1982, both now abandoned.

FIELD AND BACKGROUND OF THE INVENTION

The invention relates, in general, to the construction of large vessels and, in particular, to a new and useful method and apparatus for feederless manufacture of thick-walled, container type castings from cast iron with spheroidal graphite.

Such castings are needed, for example, as transport containers for used fuel elements from nuclear power plants. The quality of the castings must meet especially high requirements for such use. It must have a fine-trained and tough structure free of volume deficiency faults, in particular free of micropores.

Thick-walled sand casting has long solidification times, as the considerable amounts of heat being released can be removed only through the insulating mold material. In the case of heat iron with spheroidal graphite this may result in a coarse globulitic structure. Besides, under these conditions flat temperature gradients between the residual melt and the solidifying peripheral shell occur, which favor the occurrence of volume deficiency faults, in particular micropores. If the cellular structure is coarse, the volume expansion, which predominates in graphite eutectic crystallization and exerts a pressure saturating for feeding, cannot completely keep the micropores shut. The harmful consequences are microcavities which lead to readings in non-destructive testing methods and microliquations, or, in extreme cases, even to carbide segregations at the eutectic grain (cell) boundaries, which impair the toughness of the material.

German patent application DE-AS 21 23 267 discloses that for electro-slag remelting in the production of thick-walled hollow bodies to use as cores, a monolithic support body with cooling, which, after switching the cooling off and, hence, expansion and subsequent switching on again, can be pulled out of the melted ingot. The problem of the manufacture of castings from cast iron with spheroidal graphite without micropores is not dealt with in this German patent application, but rather a method for drawing of the core.

German patent application DE-AS 19 52 009 solves the same problem with a water-cooled core in electro-slag remelting by withdrawing wedge-shaped parts of the core by means of a spindle drive, the core diameter being reduced for drawing. German patent application DE-OS 28 27 091 teaches that in conventional casting of steel to billets or ingots, one should construct a chill mold of single walls from water-cooled cooling boxes. The problem of the invention of pore-free casting of cast iron with spheroidal graphite is not dealt with by this document either.

SUMMARY OF THE INVENTION

The invention obtains in a thick-walled container-type casting and by effecting a steeper temperature gradient favoring shell-type solidification in connection with a shortened solidification time, a fine-grain, low-liquation and pore-free structure, which otherwise could be achieved only in thin-walled castings.

In the inventive method, the entire mold comprising the mold core and an outer mold is constructed to be inflexible, and so that an improved heat removal as compared with sand casting is effected. The gates for passing melt to a mold cavity in the mold are dimensioned so that the cast iron solidifies in the gates before the eutectic solidification of the casting sets in in the mold cavity. Through the accelerated solidification of the cast iron in particular in the core region and the corresponding development of a steep temperature gradient in the mold cavity, the formation of a fine cellular structure is promoted and the solidification which, for sand casting, is largely globulitic, is shifted toward a solidifying peripheral shell. Both factors reduce the danger of micropore formation. The inflexible construction of the entire mold ensures that the cooling casting shrinks onto the core and thereby a gap formation is avoided and thus good heat transfer is preserved. By dimensioning the gates so that the cast iron solidifies in them before the eutectic solidification of the casting sets in, and by having an inflexible construction of the entire mold, the expansion of the metal during the graphitic eutectic solidification can become fully effective as pressure increases in the mold cavity. The result of this is that in the solidifying casting the formation of micropores is avoided.

Specifically the invention can be realized to advantage as follows:

Good heat removal can be promoted in that the castings are cooled in a metered and regulated manner at their inner surface by cooling the interior of the mold core by coolants, notably non-combustible liquid coolants which evaporate in the system. Suitable for this is liquid nitrogen or water atomized in an air stream.

The effective pressure increase in the mold cavity during the eutectic solidification can be promoted, besides by the sturdy design of the mold, by the fact that the castings are cooled at their outer surfaces. In castings, such as container for fuel elements, where the outer surfaces must be provided with cooling fins for subsequent use in practice, sufficient cooling at the outer surface can be achieved simply by forming the castings with large-size cooling fins on their outer surface. Then the outer mold can be constructed, e.g. of form-stable, cold resin-bonded quartz sand.

The cooling of the outer surfaces of the casting can be improved, e.g. in the case of relatively small cooling fins or a smooth outer surface, by a metallic outer mold. The metallic outer mold improves the removal of heat to the outside by its greater thermal conductance as compared with a ceramic mold, and thereby, as a result of higher temperature, it also improves the convection cooling by the surrounding air. This can be further improved by cooling fins on the outer mold. Besides, one can cool the metallic outer mold in a metered and regulated manner by coolants, notably by non-combustible liquid coolants evaporating in the system.

The measures for improving the external cooling of the castings promote a shell type solidification and thereby increase the pressure increase in the residual melt during the eutectic solidification, which improves the density of the casting.

In a casting mold, especially suitable for the method, comprising a mold core and an outer mold, the external contour of the mold core is formed by a dead mold of sheet steel, on the inner surface of which cooling elements traversed by coolant are arranged. The space inside the core mold which is not occupied by the cooling elements (i.e. the free space) is filled with moldable, fine-grained substances. For the dead mold, sheet steel of a thickness of 10 to 20 mm is suitable. The fine-grained substances serve for shape stabilization of the core and also promotes the heat transport between the dead chill mold and the cooling elements, in which the cooling is brought about by the through-flowing coolants. The outer surface of the core is generally provided with a coating as used in foundaries, to avoid welding on.

The cooling elements may be formed as cooling boxes, in which inflow and outflow tubes are arranged side by side, to permit uniform heat removal. The cooling boxes are advantageously held by metallic elements such as wedges and are pressed against the dead mold. Instead of cooling boxes, cooling cells may be used.

The fine-grained substance with which the free space within the mold core is filled may be ceramic molding substances as customary in foundries. To increase the thermal conductance, there may be used also fine-grained metallic substances, preferably steel shot, or metallic substances may be added to the molding material.

Advantageously, the outer mold comprises sheet steel and is provided with cooling elements. The cooling elements may be either cooling boxes or cooling coils. Additional cooling fins improve the heat removal.

Accordingly, it is an object of the invention to provide a method of manufacturing a thick-walled container casting of cast iron with spheroidal graphite which comprises forming an inflexible mold using an inner cylindrical dead mold core arranged within an outer mold, filling the space between the inner cylindrical dead mold core and the outer mold from an end thereof and cooling particularly the inner mold core over an amount of cooling which would be usual for a sand casting and dimensionsing the gate so that the cast iron solidifies in the gate before the eutectic solidification of the casting sets in.

A further object of the invention is to provide a device for manufacturing a thick-walled container casting of cast iron with spheroidal graphite which comprises an inner cylindrical dead mold core having a bottom end and a closed top end spaced inwardly of an outer top end of an outer clindrical mold and with means defining a mold filling closure closing the bottom ends of the outer and inner molds so that at least one gate which is of a size to cause solidification in the gate before the eutectic solidification of the casting takes place in the mold.

A further object of the invention is to provide a device for manufacturing a thick-walled container which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
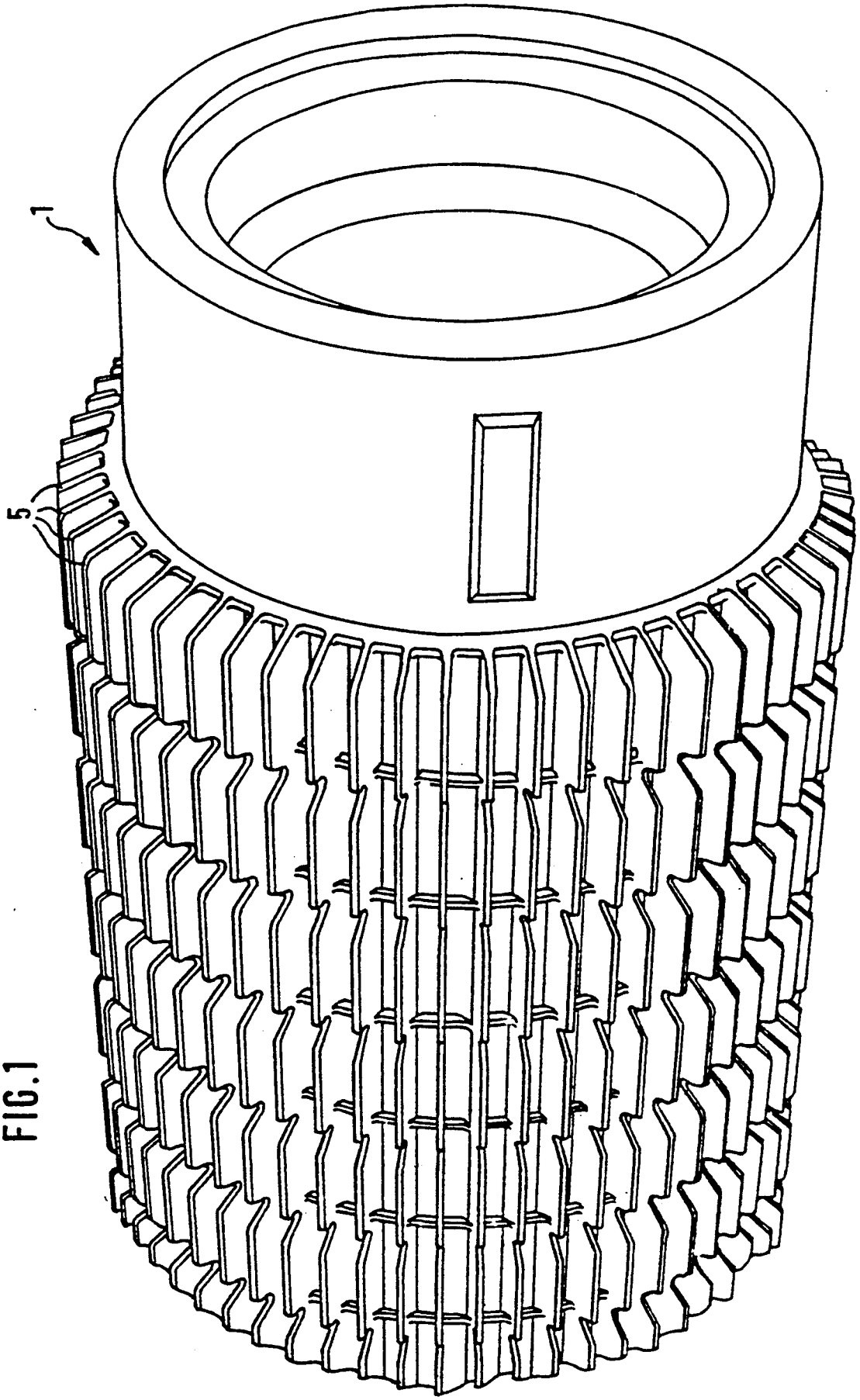
FIG. 1 is a front end perspective view of a container cast in accordance with the invention.

Referring to the drawings, in particular, the invention embodied therein comprises a method of manufacturing a thick-walled container casting 1 made of a cast iron with a spheroidal graphite which comprises forming an inflexible mold using an inner cylindrical dead mold core 6 arranged within an outer mold part 3, and filling the mold space formed between the inner and outer parts through a gate or port while cooling particularly the mold adjacent the dead mold core over an amount which would be cooled with the usual sand casting and dimensioning one or more of the gates or ports 2 so that the cast iron solidifies in the gate before the eutectic solidification of the casting sets in.

For the feederless production of a thick-walled, container type casting of cast iron with spheroidal graphite, namely a container for fuel elements 1, the entire mold was constructed to be inflexible and an improved heat removal as compared with the sand casting was arranged for, in particular at the inner surface. The gates 2 were dimensioned so that the cast iron solidified in them before the eutectic solidification of the casting 1 set in. The outer closed mold 3 is made of form-stable, cold resin-bonded quartz sand. For the production of the outer mold 3, cores or fins 4 for forming the cooling fins 5 to be produced on the exterior of the casting 1, were inserted into the mold. The closed dead mold core 6 comprises externally a cylindrical sheet iron jacket 7 about 6 m long having a wall thickness of 15 mm with a 30 mm thick cover 8 welded on. Before the welding on of the cover 8, the cooling boxes 8 and 10 are placed in two planes and pressed against the sheet jacket 7 with steel wedges 11. Good cooling of the cooling boxes 9 and 10 was achieved by a system of parallel, vertical cooling tubes, a lower feed line and an upper discharge line, distributed over the total circumference, having been installed alternately and connected to a feed and discharge ring conduit for each. Also, the cover 8 is provided with a cooling box 12. Pipes in cooling boxes 9, 10 and 12 are in a conventional serpentine form and are supplied with coolant over supply ring 16 and pipes 17. The coolant returns by pipes 18 and discharge ring 19. The core 6 is arranged upright. The casting is cast uphill. The casting temperature was 1,320° C., the quantity of magnesium-treated and seeded iron was 155 tons. The composition of the melt corresponded to a GGG-40.3, DIN 1693. This corresponds approximately to ASTM A 536, grade 60-40-18. The approximate dimensions of the casting 1 were 6,400 mm, the outside diameter with fins 2,500 mm, the inside diameter 12,00 mm, the bottom thickness was 400 mm.

Steel of grade GGG-40.3, DIN 1963 is a ferritic modular cast iron grade. According to the ASTM standard, its yield point is somewhat higher than according to the DIN standard. The somewhat higher yield points are due to the fact that in the U.S. annealing is in principle ferritizing. This is not the case with the method according to the present invention. Another U.S.A. steel grade similar to GGG-40.3, DIN 1693 is ASTMA A 395, grade 60-40-18. This U.S. steel has a somewhat lower silicon content than the steel according to the DIN standard.

For a casting according to the invention, the product analysis specification in percent by weight was: C 3.2 to 3.9, Si 1.7 to 2.3, Mn less than 0.3, P less than 0.03, S less than 0.015, Mg more than 0.03.

An FeSi-Mg or similar alloy, e.g. FeSi-Mg 30, was added to the melt in quantities such that the added magnesium content is above 0.6%, a magnesium content in the finished casting of over 0.03, e.g. 0.04%, being adjusted.

After casting, the core 6 was cooled with liquid nitrogen in such a way that upon flowing into the cooling elements 9, 10, 12 vaporization occurred. The gates 2 were dimensioned so that they froze shut when the melt in the mold had reached a temperature of 1160° to 1200° C. The cooling was maintained during the entire solidification time. Only just above the gamma-alpha transformation the coolant gas supply was turned off, in order not to disturb the ferrite formation. In all, the solidification time was shortened by the use of the cooling by 56% as compared with pure sand casting.

After completed solidification and cooling in the mold, the casting was drawn and the fine-grain tampings in the core were removed, the cooling elements disposed in several planes were taken out, and finally the formwork i.e. the jacket 7 with the cover 8, was removed by cutting open and pulling. The remaining casting was scoured in the usual manner.

The ultrasonic testing of the scoured and internally treated casting with various angle-testing heads and with frequencies of from 1 to 2 MHz gave no readings at a detectability of an equivalent magnitude of error of 3 mm.

Figure 3:
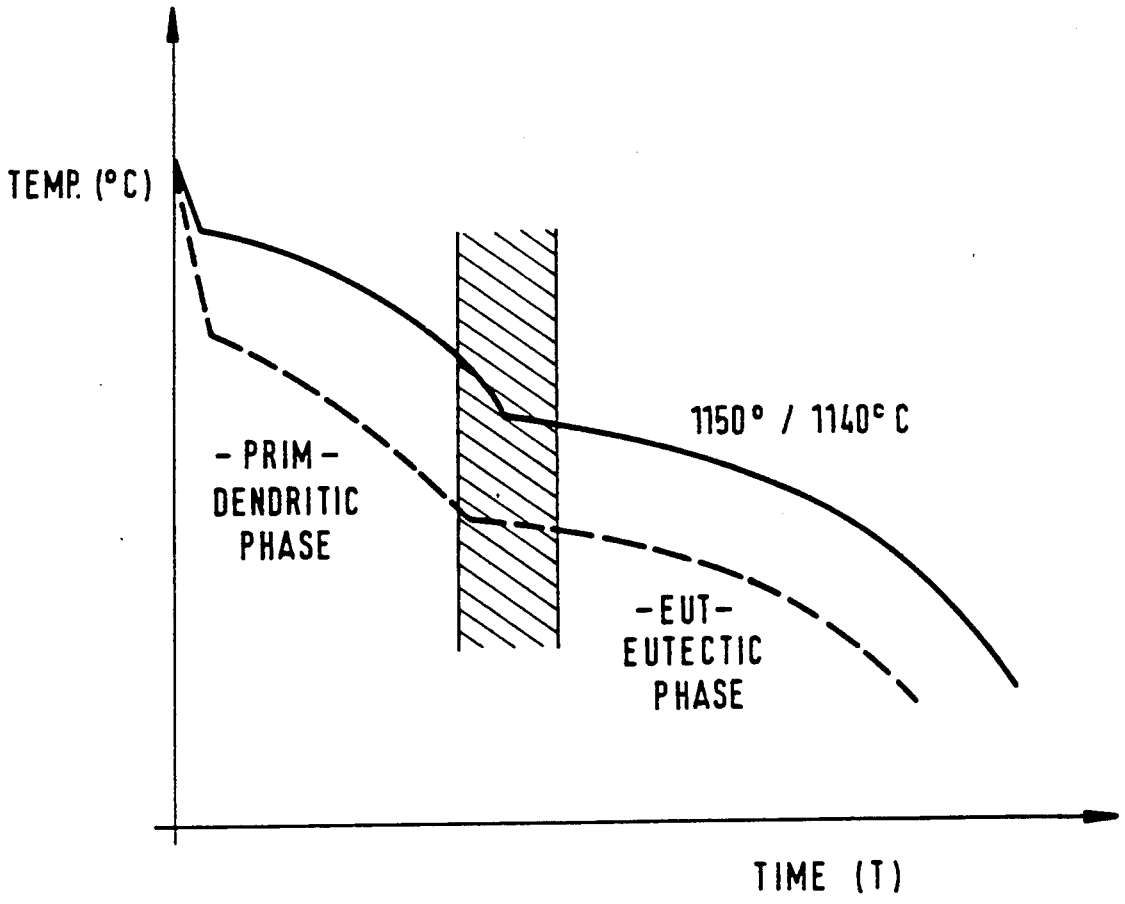
FIG. 3 is a graph showing the change of temperature with time of the cast iron melt in a mold of FIG. 2, illustrating the dendritic or PRIM phase and the eutectic or EUT solidification phase, the cross-hatched area indicating the time at which the gates or ports leading to the mold are closed.

Cast iron undergoes a two-phase solidification process as illustrated in FIG. 3. The cast iron contracts during the first dendritic or PRIM phase. According to FIG. 3, this phase continues until the melt reaches about 1,160° to 1,200° C. During all this time the gates are dimensioned so that the cast iron remains fluid within the gates. As the melt shrinks during the PRIM Phase, additional melt is provided through the gates into the cavity. As soon as the eutectic or EUT Phase begins, at the stated temperature, the gates are dimensioned so that their contents solidifies. The gates thus are effectively plugged (cross-hatched area in FIG. 3) during the expanding eutectic phase of solidification. Expansion of the cast iron melt within the closed space produces a pressure which avoids the formation of any cavities within the completed cast.

Figure 2:
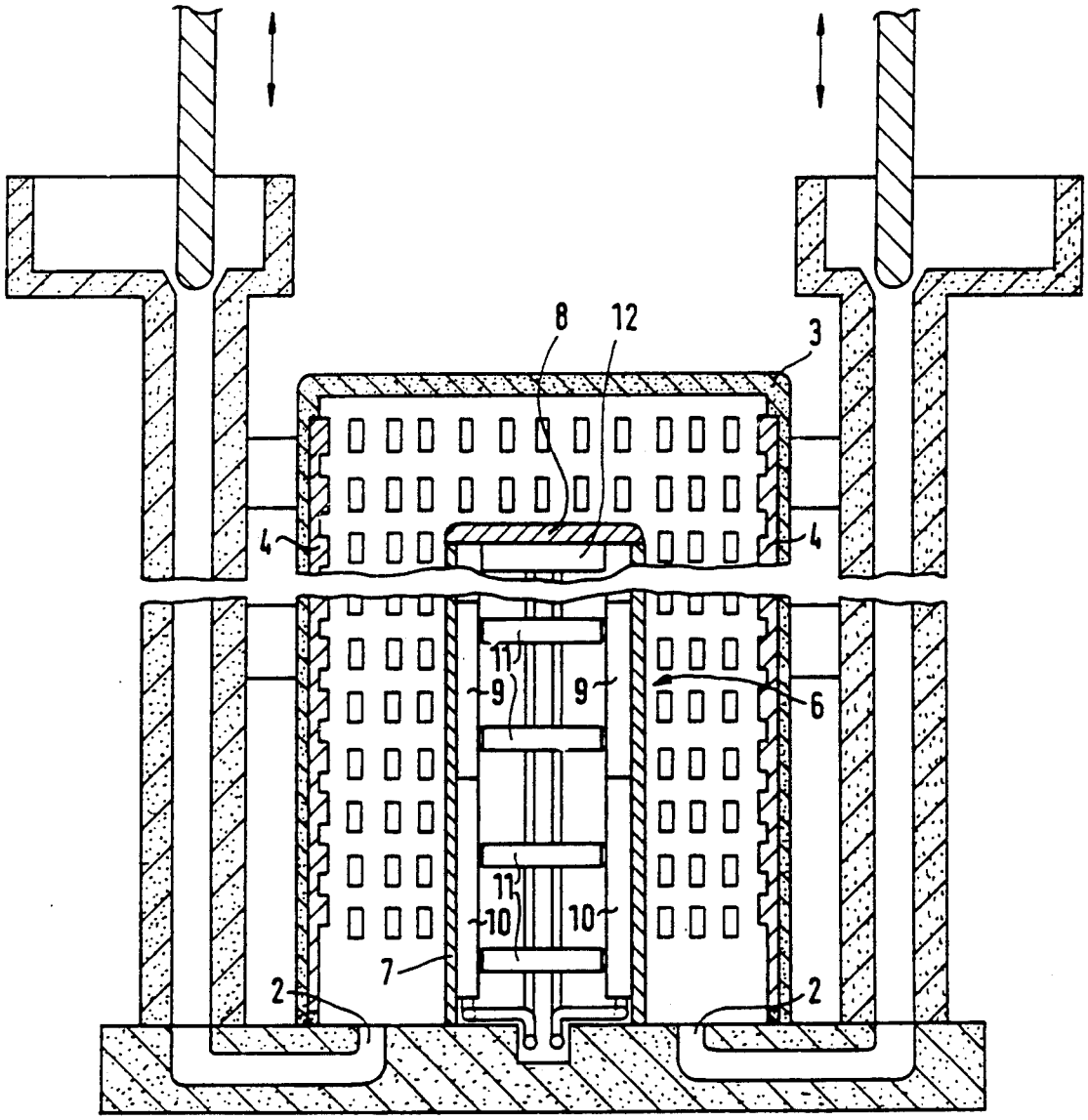
FIG. 2 is a sectional view of a casting mold for casting the container according to FIG. 1 and constructed in accordance with the invention.
Figure 2A:
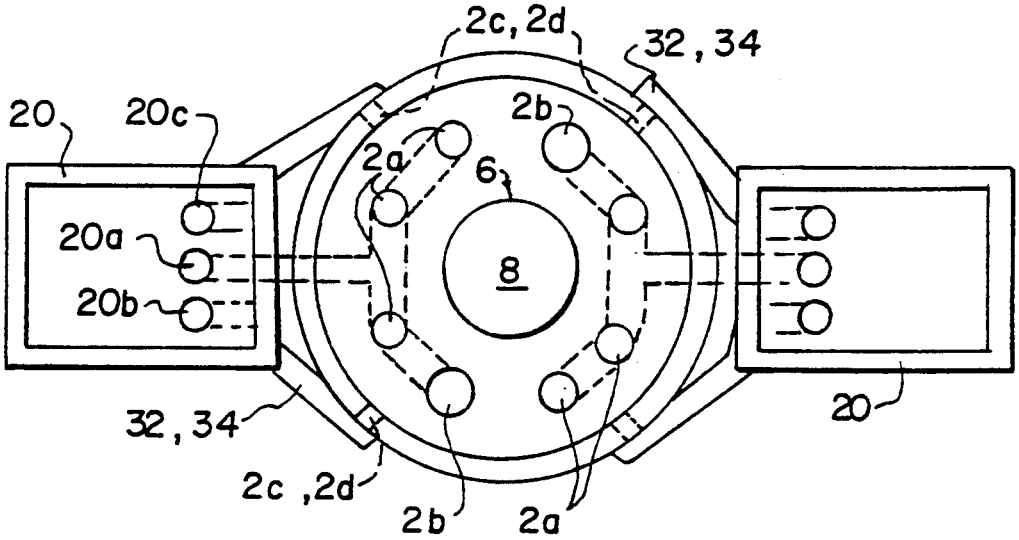
FIG. 2A is a schematic top view partly in section of the mold of FIG. 2 in stylized form, illustrating the various gates that are used to charge the melt into the mold cavity.

As shown in FIG. 2 and 2A, gates 2 include eight separate gates 2*a* and 2*b*, distributed roughly in a circle on the floor of the mold cavity around the core 6.

Of the four gates in the mold cavity floor, six of the gates labelled 2*a* have a diameter of 50 mm while two of the gates labelled 2*b*, which are diametrically opposed to each other and each connected to a separate feeding pipe 18, have a diameter of 60 mm. Each of the pipes 18 is connected to 350 mm gates 2*a* and 160 mm, gate 2*b*.

About half way up the mold cavity, four additional ports 2*c* are provided. As shown in FIG. 2A, these also are evenly distributed around the circumference of the mold. Each has a height of 60 mm and a width of 20 mm. These rectangular ports are disposed between two adjacent ribs 4. Two of the rectangular gates 2*c* are connected to one supply pipe 32, there being a supply pipe on each side of the mold.

Further up, the mold cavity for each additional gates or ports 2*d* are provided which also have a 60mm ×20mm dimension. Pipes 34 on each side of the mold each supply two gates 2*d*.

Melt is supplied to a basin 20 on each side of the mold. Each basin has three openings in its floor. As shown in FIG. 2A, opening 20*a* is connected to pipe 18, opening 20*b* is connected to pipe 32 and opening 20*c* is connected to pipe 34.

Each opening has a conical entrance which can be plugged by a stopper 22, three stoppers being provided for each basin 20.

The stoppers are manually movable in the direction of double arrows 36 for selectively opening and closing each of the holes 20*a* through 20*b*. This permits filling of the mold cavity at three distinct levels using the gates or ports 2*a* through 2*d*.

The melt is charged into basins 20 and the stoppers 32 are selectively raised to charge the melt into the mold cavity through the gates. The specific gate dimensions which are noted here were found to cause solidification of the melt in the gates at appropriate time to achieve the inventive purpose. The port dimensions were used with the old structure having the dimension and wall thicknesses set forth above and with the melt composition which is also set forth above.

An actual casting operation in accordance with the invention is now described:

The charge of metal was first melted in three furnaces (not shown) and a total of 180 metric tons were eventually charged into the mold cavity at three levels of the three sets of ports 2*a* to 2*d*.

At the start, pouring was effected only through pipes 18 and ports 2*a* and 2*d* at the bottom of the mold cavity. This was initiated by lifting the stopper 22 covering holes 20*a* in basins 20, after the basins had been filled with melt.

When the melt was initially poured into the basin, it had a temperature of 1,480° C. It was permitted to cool down to a temperature of between 1,320° to 1,350° C. At this point, the first stopper 22 for holes 20*a* was manually lifted to allow melt to pour through pipe 18 and into the lower ports 2*a* and 2*b*.

After 90 seconds, the second stoppers 22 covering holes 20*b* were manually raised, allowing metal to pass through pipes 32 and intermediate gates 2*c*. After 165 seconds, the stoppers 22 covering holes 20*c* were raised allowing melt to pass through pipes 34 and the upper gates 2*d* (which supplied metal that ultimately formed the bottom of the casting, the casting being upside down in FIG. 2).

Pouring continued for about 198 seconds in total after which melt in all of the gates solidified allowing no additional melt to pass through the pipes 18, 32 or 34.

It was found that the 50 mm diameter gate 2*a* and the rectangular gate had melt which froze up initially, presumably because of their smaller dimensions. The round 60 mm diameter gate 2*b*, at the bottom of the mold cavity, which are diametricaly opposed from each other, froze up only immediately before the start of the eutectic solidification of the casting. Until that point, cast iron melt continued to flow through the lower large diameter gate 2*d*, this compensating the volume contraction during the primary or dendritic solidification of the casing. The use of a large number of gates, 16 in total, permit a fast filling of the mold so that the temperature losses during casting remain so small that during the time of dendritic solidification, the mold is sufficiently filled with cast iron. The temperature in the still liquid casting can become equalized and eutectic solidification begins evenly and simultaneously through the entire casting.

It is noted that the stoppers 22 can be raised manually in a simple manner. For example, as shown at the right in FIG. 2, the stopper may be mounted for linear up and down movement in a slide 40. Teeth 42 are provided on the stopper 22 and engage teeth of pivotally mounted sector-shaped pinion 44. A manually rotatable arm 46 is connected to pinion 44 and can be lowered to pivot pinion 44 and thereby raise stopper 22. Similar structures can be used to raise and lower the other stoppers at appropriate times during the casting process.

While specific embodiments of the invention have been shown and described in detail to illustrate the application of the principles of the invention, it will be understood that the invention may be embodied otherwise without departing from such principles.

What is claimed is:

1. A method of manufacturing a thick-walled container casting of cast iron with spheroidal graphite, comprising: forming an inflexible closed mold of an inner closed cylindrical dead mold core arranged within an outer closed old part spaced outwardly and upwardly of the mold core to form a closed mold space; filling the mold space between the inner mold core and the outer part through a gate: actively cooling an inner mold surface of the mold space on the dead mold core by cooling an inner surface of the mold core: dimensioning the gate so that cast iron solidifies in the gate before a eutectic solidification of the casting in the mold space begins; and after the casting completely solidifies in the mold space, cutting out the mold core from the casting.

2. A method according to claim 1, wherein the inner surface of the mold core is actively cooled by pressing a plurality of cooling elements against the inner surface of the mold core and passing a non-combustible liquid coolant through each cooling element.

3. A method according to claim 1, including providing a plurality of gates at different levels to the mold space and supplying melted cast iron to gates at the separate levels, at different times so as to fill the mold space rapidly.

* * * * *